US011702962B2

(12) United States Patent
Todo et al.

(10) Patent No.: US 11,702,962 B2
(45) Date of Patent: Jul. 18, 2023

(54) STEAM TURBINE CONFIGURED TO RECOVER STATIC PRESSURE OF STEAM IN DIFFUSER

(71) Applicant: MITSUBISHI HEAVY INDUSTRIES COMPRESSOR CORPORATION, Tokyo (JP)

(72) Inventors: Masatomo Todo, Hiroshima (JP); Akito Kunimoto, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/381,680

(22) Filed: Jul. 21, 2021

(65) Prior Publication Data

US 2022/0082025 A1 Mar. 17, 2022

(30) Foreign Application Priority Data

Sep. 15, 2020 (JP) ..... 2020-154499

(51) Int. Cl.
*F01D 25/30* (2006.01)
*F01D 1/10* (2006.01)
(Continued)

(52) U.S. Cl.
CPC ..... *F01D 25/30* (2013.01); *F01D 1/10* (2013.01); *F01D 9/041* (2013.01); *F01D 11/02* (2013.01); *F05D 2220/31* (2013.01)

(58) Field of Classification Search
CPC ..... F01D 25/24; F01D 25/30; F01D 11/00; F01D 11/02; F01D 1/10; F01D 9/02;
(Continued)

(56) References Cited

U.S. PATENT DOCUMENTS 5,257,906 A * 11/1993 Gray ..... F01D 25/30 415/225
2012/0034064 A1* 2/2012 Nanda ..... F01D 25/30 415/206
(Continued)

FOREIGN PATENT DOCUMENTS

JP 2004-353629 A 12/2004

*Primary Examiner* — Woody A Lee, Jr.
*Assistant Examiner* — Elton K Wong
(74) *Attorney, Agent, or Firm* — Osha Bergman Watanabe & Burton LLP

(57) ABSTRACT

A steam turbine has a diffuser that is configured to guide steam to an outside of a casing. The diffuser has an outer guide that gradually expands to an outer side in a radial direction and an inner guide that is disposed at intervals to an inner side in the radial direction with respect to the outer guide. The inner guide has an inner curved diameter-expanded portion that gradually expands to the outer side in the radial direction while being curved from the first side to the second side in the axial direction. The outer guide has a first diameter-expanded portion that gradually expands to the outer side in the radial direction with a first radius of curvature, and a second diameter-expanded portion that gradually expands to the outer side in the radial direction with a second radius of curvature larger than the first radius of curvature.

2 Claims, 3 Drawing Sheets

(51) Int. Cl.
*F01D 9/04* (2006.01)
*F01D 11/02* (2006.01)

(58) Field of Classification Search
CPC ..... F01D 9/04; F01D 9/041; F05D 2220/31; F04D 29/54; F04D 29/541; F04D 29/545; F04D 29/547
See application file for complete search history.

(56) References Cited

U.S. PATENT DOCUMENTS

2015/0063992 A1* 3/2015 Noguchi ..... F01D 1/04 415/199.5
2018/0202320 A1* 7/2018 Mitsui ..... F01D 25/30

* cited by examiner

STEAM TURBINE CONFIGURED TO RECOVER STATIC PRESSURE OF STEAM IN DIFFUSER

BACKGROUND OF THE INVENTION

Field of the Invention

The present disclosure relates to a steam turbine.

Priority is claimed on Japanese Patent Application No. 2020-154499, filed Sep. 15, 2020, the content of which is incorporated herein by reference.

Description of Related Art

The steam turbine includes a diffuser on the downstream side of a compression stage of a final stage for recovering static pressure and discharging steam to the outside. For example, Japanese Unexamined Patent Application, First Publication No. 2004-353629 discloses a configuration in which a turbine casing has a diffuser formed by a double structure of an outer casing and an inner casing. The diffuser is formed such that a cross-sectional area of a flow passage thereof gradually expands from the upstream side to the downstream side. With such a diffuser, the static pressure can be recovered by guiding the flow of steam discharged from the compression stage of the final stage.

SUMMARY OF THE INVENTION

However, in the steam turbine as described above, when the flow velocity of the steam flowing inside is high, the flow velocity of the steam at an outlet of the compression stage of the final stage may become a transonic speed or a subsonic speed. When the flow velocity of steam becomes the transonic speed or the subsonic speed, the steam may cause a shock wave or separation in the diffuser. Therefore, it is desired to recover the static pressure more effectively in the diffuser and improve the efficiency of the steam turbine.

The present disclosure provides a steam turbine capable of efficiently recovering the static pressure of steam in a diffuser.

A steam turbine according to the present disclosure includes a rotor shaft that is configured to rotate about an axis, a plurality of rotor blade rows that are fixed to an outer side in a radial direction about the axis with respect to the rotor shaft and disposed at intervals in an axial direction along which the axis extends, a casing that covers the rotor shaft and the plurality of rotor blade rows, and stator vane rows that are fixed to the casing, in which each of the stator vane rows is disposed at intervals on a first side in the axial direction with respect to each of the plurality of rotor blade rows, in which the casing has a diffuser that is configured to guide steam flowing out from a rotor blade row of a final stage, which is disposed on a second side farthest in the axial direction among the plurality of rotor blade rows, to an outside of the casing, the diffuser includes an outer guide that gradually expands to the outer side in the radial direction from the first side to the second side in the axial direction, and an inner guide that is disposed at intervals to the inner side in the radial direction with respect to the outer guide and gradually expands to the outer side in the radial direction from the first side to the second side in the axial direction, the inner guide has an inner curved diameter-expanded portion that gradually expands to the outer side in the radial direction while curving from the first side to the second side in the axial direction, and the outer guide includes a first diameter-expanded portion that is disposed in a region closest to the rotor blade row of the final stage in the axial direction and gradually expands to the outer side in the radial direction with a first radius of curvature from the first side to the second side in the axial direction, and a second diameter-expanded portion that is connected to the first diameter-expanded portion on the second side in the axial direction and gradually expands to the outer side in the radial direction with a second radius of curvature larger than the first radius of curvature from the first side to the second side in the axial direction.

Another steam turbine according to the present disclosure includes a rotor shaft that is configured to rotate about an axis, a plurality of rotor blade rows that are fixed to an outer side in a radial direction about the axis with respect to the rotor shaft and disposed at intervals in an axial direction along which the axis extends, a casing that covers the rotor shaft and the plurality of rotor blade rows, and stator vane rows that are fixed to the casing, in which each of the stator vane rows is disposed at intervals on a first side in the axial direction with respect to each of the plurality of rotor blade rows, in which the casing has a diffuser that is configured to guide steam flowing out from the rotor blade row of a final stage, which is disposed on a second side farthest in the axial direction among the plurality of rotor blade rows, to an outside of the casing, the diffuser includes an outer guide that gradually expands to the outer side in the radial direction from the first side to the second side in the axial direction, an inner guide that is disposed at intervals to the inner side in the radial direction with respect to the outer guide and gradually expands to the outer side in the radial direction from the first side to the second side in the axial direction, and the diffuser includes a first region that is a region closest to the rotor blade row of the final stage in the axial direction, and in which a cross-sectional area of a flow passage defined between the outer guide and the inner guide gradually decreases toward the second side in the axial direction, and a second region that is connected to the first region on the second side in the axial direction, in which the cross-sectional area of the flow passage gradually increases toward the second side in the axial direction.

According to the steam turbine of the present disclosure, it is possible to efficiently recover the static pressure of steam in the diffuser.

DETAILED DESCRIPTION OF THE INVENTION

Hereinafter, an embodiment of a steam turbine according to the present disclosure will be described below with reference to the accompanying drawings. However, the present disclosure is not limited to the embodiment.

First Embodiment

Configuration of Steam Turbine

Figure 1:
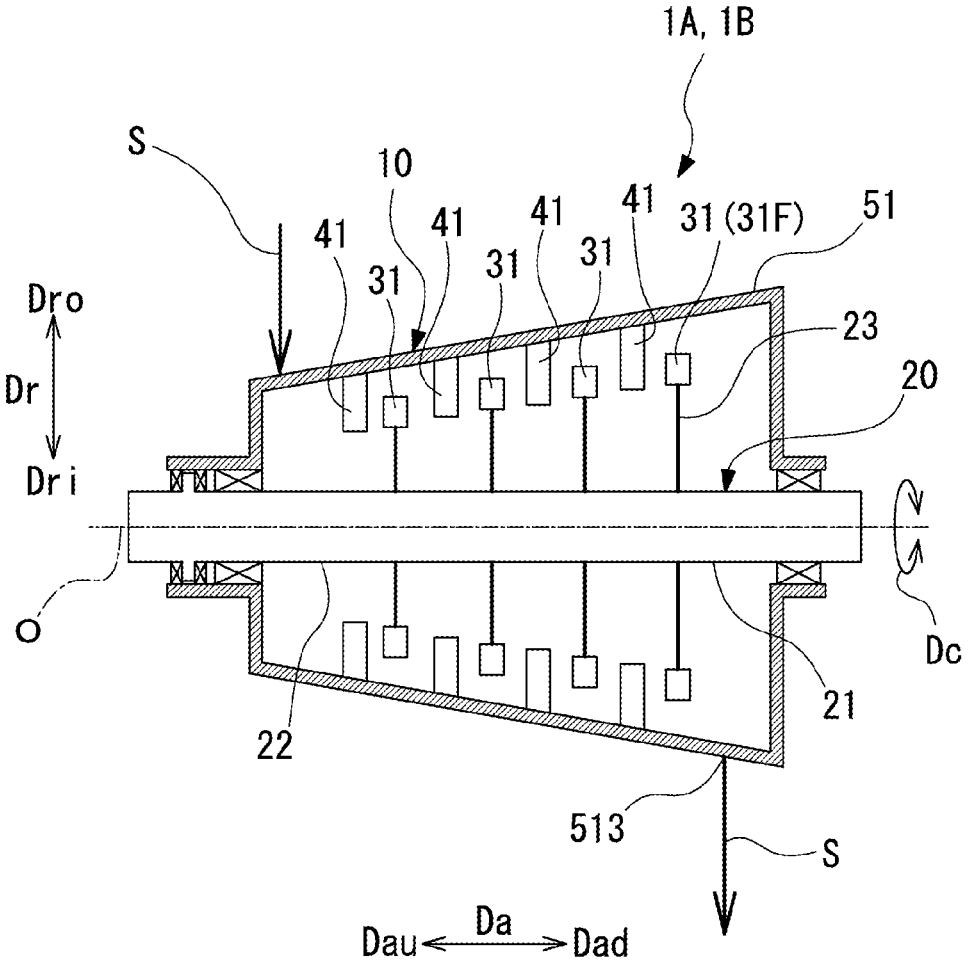
FIG. 1 is a schematic view showing an overall configuration of a steam turbine according to an embodiment of the present disclosure.

As shown in FIG. 1, a steam turbine 1A of the present embodiment has a rotor 20 that rotates about an axis O and a casing 10 that covers the rotor 20.

For the convenience of the following description, a direction in which the axis O extends is referred to as an axial direction Da. In addition, a radial direction in the rotor 20 with respect to the axis O is simply referred to as a radial direction Dr. Further, a circumferential direction of the rotor 20 about the axis O is simply referred to as a circumferential direction Dc.

Configuration of Rotor

The rotor 20 has a rotor shaft 21 and a rotor blade row 31. The rotor shaft 21 extends in the axial direction Da about the axis O. The rotor shaft 21 is rotatable about the axis O. The rotor shaft 21 has a shaft core portion 22 and a plurality of disc portions 23. The shaft core portion 22 is formed in a columnar shape about the axis O and extends in the axial direction Da. The plurality of disc portions 23 are disposed at intervals in the axial direction Da. Each disc portion 23 is integrally formed with the shaft core portion 22 so as to constitute an outer peripheral portion of the rotor shaft 21. Each disc portion 23 is disposed so as to extend from the shaft core portion 22 to the outer side Dro in the radial direction Dr.

Configuration of Rotor Blade Row

The rotor blade row 31 is fixed to the outer side Dro of the rotor shaft 21 in the radial direction Dr. A plurality of rows of rotor blade row 31 are disposed at intervals along the axial direction Da of the rotor shaft 21. In the case of the present embodiment, the rotor blade rows 31 are disposed in four rows, for example. Therefore, in the case of the present embodiment, the rotor blade rows 31 are disposed from the first row to the fourth row of rotor blade rows 31.

Figure 2:
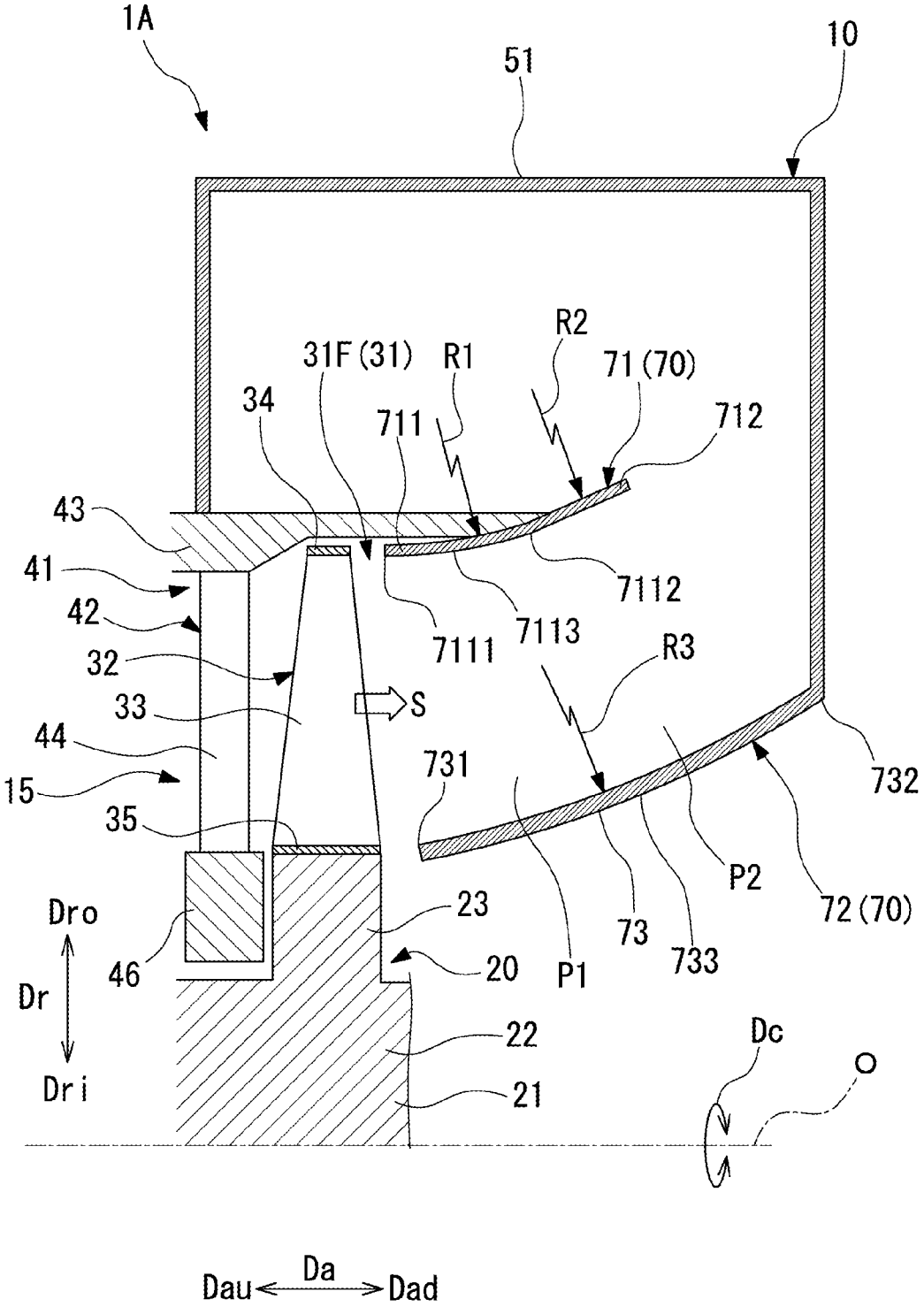
FIG. 2 is a cross-sectional view showing a configuration around a diffuser according to the first embodiment of the steam turbine.

As shown in FIG. 2, the rotor blade rows 31 of each row have a plurality of rotor blades 32 arranged side by side in the circumferential direction Dc. The plurality of rotor blades 32 are attached side by side on an outer circumference of the disc portion 23. Each rotor blade 32 has a rotor blade main body 33, a shroud 34, and a platform 35.

Each rotor blade main body 33 extends in the radial direction Dr. The shroud 34 is disposed on the outer side Dro in the radial direction Dr with respect to the rotor blade main body 33. The platform 35 is disposed on an inner side Dri in the radial direction Dr with respect to the rotor blade main body 33. The platform 35 is fixed to the disc portion 23. In the rotor blade 32, a part of a steam main flow passage 15 which is a flow passage through which steam S flows is formed between the shroud 34 and the platform 35. That is, the steam main flow passage 15 is formed between the shroud 34 positioned on an outer peripheral edge of the rotor blade row 31 and the platform 35 positioned on an inner peripheral edge of the rotor blade row 31. By disposing a plurality of rotor blades 32 side by side in the circumferential direction Dc, the steam main flow passage 15 is formed in an annular shape on the outer peripheral portion of the rotor 20.

Configuration of Casing

The casing 10 is formed so as to cover the rotor shaft 21, the plurality of rotor blade rows 31, that is, the rotor 20. A stator vane row 41 is fixed to the inner side Dri of the radial direction Dr in the casing 10. A plurality of stator vane rows 41 are disposed at intervals along the axial direction Da. In the present embodiment, the number of rows of the stator vane rows 41 is disposed in the same four rows as that of the rotor blade rows 31. The stator vane rows 41 are disposed so as to be arranged side by side at intervals on a first side Dau in the axial direction Da with respect to each rotor blade row 31. The stator vane row 41 constitutes one compression stage together with the rotor blade row 31. Therefore, in the present embodiment, the four rows of rotor blade rows 31 and the stator vane rows 41 constitute four compression stages having the fourth stages as the final stage.

Configuration of Stator Vane Row

The stator vane row 41 of each row has a plurality of stator vanes 42 arranged side by side in the circumferential direction Dc. The stator vane row 41 has an outer ring 43, a stator vane main body 44, and an inner ring 46. The outer ring 43 is formed in an annular shape. The outer ring 43 is disposed on the outer side Dro of the stator vane main body 44 in the radial direction Dr. The inner ring 46 is formed in an annular shape. The inner ring 46 is disposed on the inner side Dri of the stator vane main body 44 in the radial direction Dr. An annular space between the outer ring 43 and the inner ring 46 forms a part of the steam main flow passage 15 through which the steam S flows.

The steam main flow passage 15 extends in the axial direction Da across a plurality of rotor blade rows 31 and stator vane rows 41. Here, the first side Dau in the axial direction Da is the upstream side in the flow direction of the steam S in the steam main flow passage 15. In addition, a second side Dad in the axial direction Da is on the opposite side to the first side Dau, and is the downstream side in the flow direction of the steam S in the steam main flow passage 15. That is, the steam S flows in the casing 10 from the first side Dau to the second side Dad in the axial direction Da.

The casing 10 includes an exhaust casing 51 and a diffuser 70. The exhaust casing 51 is connected to the outside of the casing 10. The exhaust casing 51 discharges the steam S flowing through the steam main flow passage 15 to the outside of the casing 10. The exhaust casing 51 is disposed on the second side Dad farthest in the axial direction Da in the casing 10. An exhaust port 513 (refer to FIG. 1) that opens downward is formed in a lower portion of the exhaust casing 51. The exhaust casing 51 exhausts the steam S whose static pressure has been recovered by the diffuser 70, which will be described later, to the outside through the exhaust port 513.

Configuration of Diffuser

The diffuser 70 guides the steam S flowing out from the rotor blade row 31F of the final stage, which is disposed on the second side Dad farthest in the axial direction Da among a plurality of the rotor blade rows 31, to the outside of the casing 10 via the exhaust casing 51. The diffuser 70 is disposed between the rotor blade row 31F of the final stage and the exhaust casing 51. The diffuser 70 of the present embodiment has an outer guide 71 and an inner guide 72.

Configuration of Outer Guide

The outer guide 71 is disposed on the second side Dad in the axial direction Da with respect to the rotor blade row 31F of the final stage. The outer guide 71 is formed so as to gradually expand to the outer side Dro in the radial direction Dr from the first side Dau to the second side Dad in the axial direction Da. The outer guide 71 of the present embodiment is curved so as to be convex toward the inner side Dri in the radial direction Dr. The outer guide 71 has a first diameter-expanded portion 711 and a second diameter-expanded portion 712.

The first diameter-expanded portion 711 is disposed on the first side Dau farthest in the axial direction Da in the outer guide 71. That is, in the present embodiment, the first diameter-expanded portion 711 is disposed at a position closest to the rotor blade row 31F of the final stage in the outer guide 71. The first diameter-expanded portion 711 is formed so as to gradually expand to the outer side Dro in the radial direction Dr at a first radius of curvature R1 from the first side Dau to the second side Dad in the axial direction Da. The first diameter-expanded portion 711 is formed in a curved plate shape with the first radius of curvature R1 in a cross-sectional view parallel to and orthogonal to the axis O. Specifically, the first diameter-expanded portion 711 is formed by curving, in a cross-sectional view parallel to and orthogonal to the axis O, such that an intermediate portion 7113 of the diameter-enlarged portion in the axial direction Da extends to the inner side Dri in the radial direction Dr with respect to a first end 7111 of the first diameter-enlarged portion of the first side Dau in the axial direction Da and a second end 7112 of the second diameter-enlarged portion of the second side Dad in the axial direction Da.

The second diameter-expanded portion 712 is disposed on the second side Dad in the axial direction Da with respect to the first diameter-expanded portion 711. The second diameter-expanded portion 712 is integrally formed so as to be connected to the first diameter-expanded portion 711 by the second side Dad in the axial direction Da. In the present embodiment, the second diameter-expanded portion 712 is formed so as to gradually expand to the outer side Dro in the radial direction Dr from the first side Dau to the second side Dad in the axial direction Da. The second diameter-expanded portion 712 has a second radius of curvature R2 larger than the first radius of curvature R1 and gradually expands to the outer side in the radial direction Dr. The second diameter-expanded portion 712 is formed in a curved plate shape with the second radius of curvature R2 in a cross-sectional view parallel to and orthogonal to the axis O. Specifically, the second radius of curvature R2 is preferably as large as possible with respect to the first radius of curvature R1. That is, the second diameter-expanded portion 712 expands more slowly than the first diameter-expanded portion 711. In the present embodiment, the second diameter-expanded portion 712 linearly expands in diameter from the first side Dau to the second side Dad in the axial direction Da.

Configuration of Inner Guide

The inner guide 72 is disposed at intervals in the inner side Dri in the radial direction with respect to the outer guide 71. As a result, an annular flow passage 100, which is the flow passage through which the steam S can flow, is defined between the outer guide 71 and the inner guide 72. The annular flow passage 100 is defined between the outer guide 71 and the inner guide 72 so as to form an annular shape when viewed from the axial direction Da. The annular flow passage 100 is connected to the steam main flow passage 15 by the second side Dad in the axial direction Da. The inner guide 72 is formed so as to gradually expand to the outer side Dro in the radial direction Dr from the first side Dau to the second side Dad in the axial direction Da with a third radius of curvature R3. The inner guide 72 has an inner curved diameter-expanded portion 73. The inner curved diameter-expanded portion 73 is formed in a curved plate shape with the third radius of curvature R3 in a cross-sectional view parallel to and orthogonal to the axis O. Specifically, the inner curved diameter-expanded portion 73 is formed by curving, in a cross-sectional view parallel to and orthogonal to the axis O, such that an intermediate portion 733 of the inner guide between a first end 731 of the inner guide and a second end 732 of the inner guide extends to the inner side Dri in the radial direction Dr with respect to the first end 731 of the inner guide of the first side Dau in the axial direction Da and the second end 732 of the inner guide of the second side Dad in the axial direction Da. The third radius of curvature R3 is preferably set be larger than the first radius of curvature R1 of the first diameter-expanded portion 711. In the present embodiment, the third radius of curvature R3 is larger than the first radius of curvature R1 and smaller than the second radius of curvature R2. The third radius of curvature R3 is not limited to being smaller than the second radius of curvature R2 as long as the third radius of curvature R3 is larger than the first radius of curvature R1. Accordingly, the third radius of curvature R3 may be the same as the second radius of curvature R2.

In addition, the diffuser 70 is divided into a first region P1 positioned on the first side Dau in the axial direction Da and a second region P2 positioned on the second side Dad in the axial direction Da.

The first region P1 is a region closest to the rotor blade row 31F of the final stage in the axial direction Da. The first diameter-expanded portion 711 is disposed in the first region P1. In the first region P1, a part of the inner curved diameter-expanded portion 73 including the first end 731 of the inner guide is disposed.

The second region P2 is a region connected to the first region P1 by a second side Dad in the axial direction Da. The second diameter-expanded portion 712 is disposed in the second region P2. A part of the inner curved diameter-expanded portion 73 including the second end 732 of the inner guide is disposed in the second region P2.

In addition, a length L2 of the second region P2 in the axial direction Da is preferably, for example, about 0.5 to 2.0 times a length L1 of the first region P1 in the axial direction Da. Here, the length L1 of the first region P1 and the length L2 of the second region P2 are the lengths near the center of the annular flow passage 100 in the radial direction Dr in each region. Further, the length L2 of the second region P2 is preferably about 0.7 to 1.5 times the length L1 of the first region P1. In particular, the length L2 of the second region P2 is further preferably about 0.8 to 1.2 times the length L1 of the first region P1.

Action Effect

Generally, when the steam turbine 1A is in rated operation, the flow velocity (average flow velocity) of the steam S flowing out from the rotor blade row 31F of the final stage may be the transonic speed. Further, the flow velocity distribution of the steam S flowing out from the rotor blade row 31F of the final stage gradually increases from the inner side Dri to the outer side Dro in the radial direction Dr due to the influence of the centrifugal force by the rotor blade row 31. Therefore, when the flow velocity of the steam S flowing out from the rotor blade row 31F of the final stage is transonic speed, the flow velocity of the steam S is further increased in a region close to the shroud 34. Accordingly, in the annular flow passage 100, the steam S flows obliquely toward the outer side Dro in the radial direction Dr with respect to the axis O. As a result, the steam S flowing in the diffuser 70 is easily separated off from a wall surface forming the diffuser 70 before flowing into the exhaust casing 51. When the separation occurs, the exhaust loss increases.

On the other hand, in the steam turbine 1A having the above-described configuration, the inner curved diameter-expanded portion 73 is curved. Accordingly, the steam S flowing out from the rotor blade row 31F of the final stage flows along the inner curved diameter-expanded portion 73 in the portion close to the inner guide 72 in the radial direction Dr. As a result, in the vicinity of the inner curved diameter-expanded portion 73, the steam S flows such that the flow direction is changed to the outer side Dro in the radial direction Dr while suppressing the separation from the inner curved diameter-expanded portion 73. In addition, the first diameter-expanded portion 711 is curved with the first radius of curvature R1. Therefore, the steam S flowing out from the rotor blade row 31F of the final stage flows, in the first region P1, along the first diameter-expanded portion 711 in the portion close to the outer guide 71 in the radial direction Dr. By flowing the steam S along the curved surface, the steam S flowing out from the rotor blade row 31F of the final stage can be efficiently guided. After that, the steam S flowing in the portion close to the outer guide 71 in the radial direction Dr flows, in the second region P2, along the second diameter-expanded portion 712. The second diameter-expanded portion 712 slowly expands to the outer side Dro in the radial direction Dr as compared with the first diameter-expanded portion 711. Thus, the second diameter-expanded portion 712 is formed along the direction in which the steam S flowing from the first diameter-expanded portion 711 separates off. Therefore, the flow of the steam S can be suppressed to the inner side Dri in the radial direction Dr as compared with when the second diameter-expanded portion 712 is formed with the first radius of curvature R1 such that the first diameter-expanded portion 711 is extended as it is. Therefore, the steam S flowing along the first diameter-expanded portion 711 flows along the second diameter-expanded portion 712 without causing separation. In this way, by increasing the radius of curvature on the downstream side (second side Dad) of the outer guide 71, it is possible to suppress the occurrence of separation in the flow of the steam S on the outer side Dro in the radial direction Dr. In this way, the diffuser 70 can reduce the flow velocity while suppressing the separation of the steam S. Therefore, even when the flow velocity (average flow velocity) of the steam S flowing out from the rotor blade row 31F of the final stage is transonic speed, the occurrence of separation can be suppressed. Accordingly, it is possible to efficiently recover the static pressure of the steam S in the diffuser 70.

In addition, in the steam turbine 1B, the third radius of curvature R3 of the inner curved diameter-expanded portion 73 is larger than the first radius of curvature R1 of the first diameter-expanded portion 711. Thus, the occurrence of separation can be efficiently suppressed even on the inner side Dri in the radial direction Dr. As a result, it becomes possible to more efficiently recover the static pressure of the steam S in the diffuser 70.

In addition, in the steam turbine 1A, the length L2 of the axial direction Da of the second region P2 is 0.5 to 2.0 times the length L1 of the axial direction Da of the first region P1. That is, the length of the second diameter-expanded portion 712 in the axial direction Da is 0.5 to 2.0 times the length of the first diameter-expanded portion 711 in the axial direction Da. As a result, the flow velocity of the steam S can be adjusted in a well-balanced manner in the first region P1 and the second region P2. Therefore, it is possible to efficiently recover the static pressure.

Second Embodiment

Next, a second embodiment of the steam turbine 1B according to the present disclosure will be described. In the second embodiment described below, the same reference numerals are given in the drawings to the configurations common to the first embodiment, and the description thereof will be omitted.

Configuration of Heat Exchange Device

Figure 3:
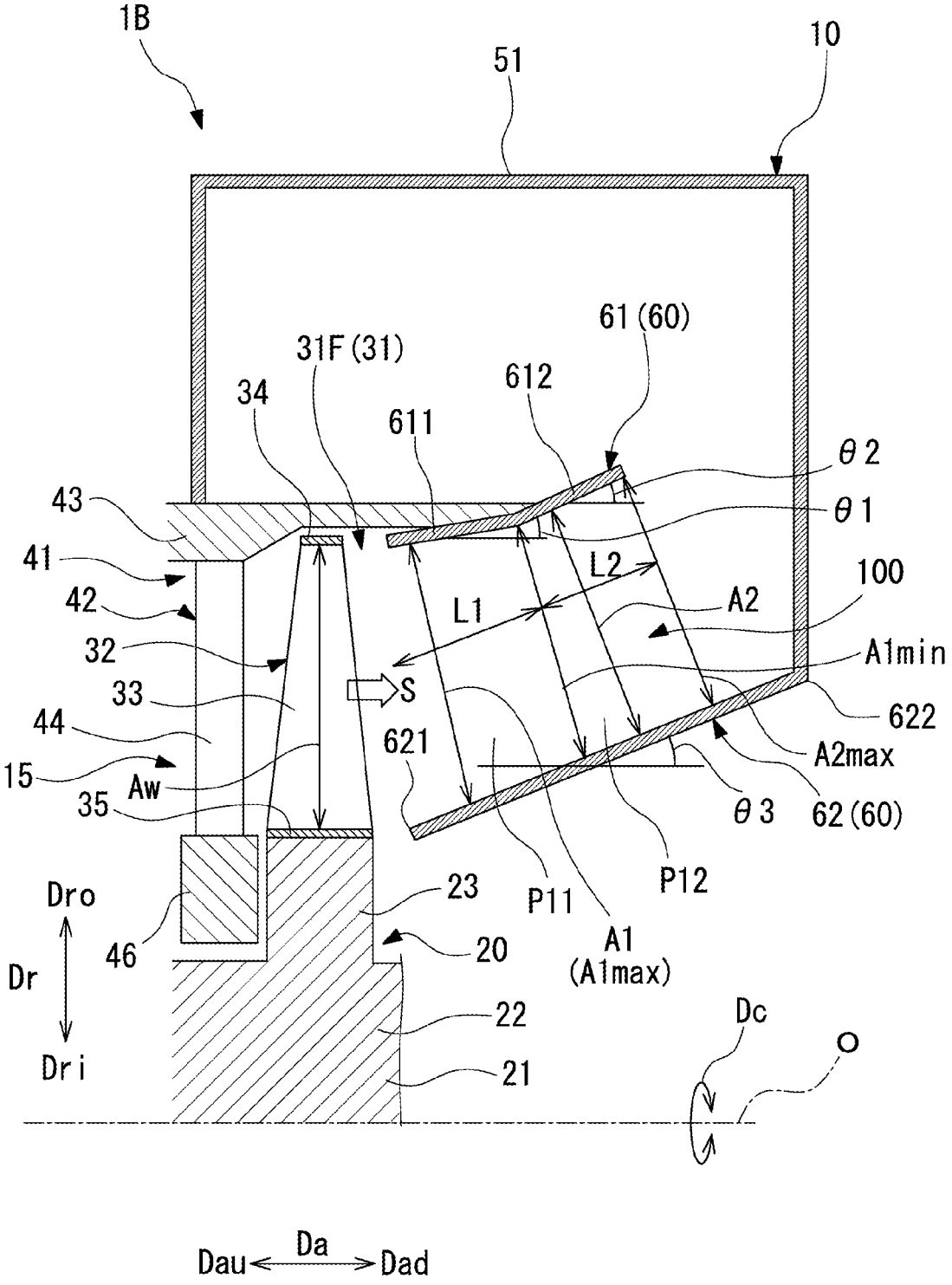
FIG. 3 is a cross-sectional view showing a configuration around a diffuser according to the second embodiment of the steam turbine.

As shown in FIG. 3, in the steam turbine 1B of the second embodiment, the structure of the diffuser 60 is different from that of the first embodiment.

Configuration of Diffuser

The diffuser 60 of the second embodiment has an outer guide 61 and an inner guide 62.

Configuration of Outer Guide

The outer guide 61 is disposed on the second side Dad in the axial direction Da with respect to the rotor blade row 31F of the final stage. The outer guide 61 is formed so as to gradually expand to the outer side Dro in the radial direction Dr from the first side Dau to the second side Dad in the axial direction Da. The outer guide 61 has a first inclined portion 611 and a second inclined portion 612.

The first inclined portion 611 is disposed on the first side Dau farthest in the axial direction Da in the outer guide 61. That is, in the present embodiment, the first inclined portion 611 is disposed at a position closest to the rotor blade row 31F of the final stage in the outer guide 61. The first inclined portion 611 is formed so as to gradually expand to the outer side Dro in the radial direction Dr from the first side Dau to the second side Dad in the axial direction Da. The first inclined portion 611 is inclined at a first inclination angle θ1 with respect to the axis O in a cross-sectional view parallel to and orthogonal to the axis O. The first inclined portion 611 is formed in a flat plate shape in a cross-sectional view parallel to and orthogonal to the axis O. That is, the first inclined portion 611 is formed linearly in a cross-sectional view parallel to and orthogonal to the axis O.

The second inclined portion 612 is disposed on the second side Dad in the axial direction Da with respect to the first inclined portion 611. The second inclined portion 612 is formed integrally with the first inclined portion 611. The second inclined portion 612 is formed so as to gradually expand to the outer side Dro in the radial direction Dr from the first side Dau to the second side Dad in the axial direction Da. The second inclined portion 612 is inclined at a second inclination angle θ2 larger than the first inclination angle θ1 with respect to the axis O in a cross-sectional view parallel to and orthogonal to the axis O. The second inclined portion 612 is formed in a flat plate shape in a cross-sectional view parallel to and orthogonal to the axis O. That is, the second inclined portion 612 is formed linearly in a cross-sectional view parallel to and orthogonal to the axis O.

Configuration of Inner Guide

The inner guide 62 is disposed at intervals in the inner side Dri in the radial direction Dr with respect to the outer guide 61. As a result, an annular flow passage 100, which is the flow passage through which the steam S can flow, is defined between the outer guide 61 and the inner guide 62. The inner guide 62 is formed so as to gradually expand to the outer side Dro in the radial direction Dr from the first side Dau to the second side Dad in the axial direction Da. The length of the axial direction Da of the inner guide 62 is formed to be longer than the length of the axial direction Da of the outer guide 61. The inner guide 62 extends to be longer than the outer guide 61 on the second side Dad in the axial direction Da. The inner guide 62 is inclined at a third inclination angle θ3 with respect to the axis O in a cross-sectional view parallel to and orthogonal to the axis O. The inner guide 62 is formed in a flat plate shape in a cross-sectional view parallel to and orthogonal to the axis O. Accordingly, the inner guide 62 is formed so as to extend linearly and straight without bending even once from the first end 621 of the inner guide of the first side Dau in the axial direction Da toward the second end 622 of the inner guide of the second side Dad in the axial direction Da in a cross sectional view parallel and perpendicular to the axis O. The angle of the third inclination angle θ3 with respect to the axis O is larger than that of the first inclination angle θ1 and smaller than that of the second inclination angle θ2.

The first inclined portion 611 is disposed in the first region P11 of the second embodiment. A part of the inner guide 62 including the first end 621 of the inner guide is disposed in the first region P11. In the first region P11, a cross-sectional area of the annular flow passage 100, which is a flow passage defined between the outer guide 61 and the inner guide 62, gradually decreases from the first side Dau to the second side Dad in the axial direction Da. That is, in the first region P11, the cross-sectional area of the annular flow passage 100 is maximum on the first side Dau in the axial direction Da and minimum on the second side Dad in the axial direction Da. The minimum cross-sectional area A1min of the annular flow passage 100 in the first region P11 is formed to be larger than a cross-sectional area Aw of the steam main flow passage 15 in the rotor blade row 31F of the final stage.

The second inclined portion 612 is disposed in the second region P12 of the second embodiment. A part of the inner guide 62 including the second end 622 of the inner guide is disposed in the second region P12. In the second region P12, a cross-sectional area A2 of the annular flow passage 100 is formed so as to gradually increase toward the second side Dad in the axial direction Da. That is, in the second region P12, the cross-sectional area of the annular flow passage 100 is the minimum on the first side Dau in the axial direction Da and maximum on the second side Dad in the axial direction Da. The maximum cross-sectional area A2max of the annular flow passage 100 in the second region P12 is formed so as to be larger than the maximum cross-sectional area A1max of the annular flow passage 100 in the first flow passage 101.

In addition, a length L2 of the second region P12 in the axial direction Da is preferably, for example, about 0.5 to 2.0 times a length L1 of the first region P11 in the axial direction Da. Further, the length L2 of the second region P12 is preferably about 0.7 to 1.5 times the length L1 of the first region P11. In particular, the length L2 of the second region P12 is further preferably about 0.8 to 1.2 times the length L1 of the first region P11.

Action Effect

In a case where the flow velocity (average flow velocity) of the steam S flowing out from the rotor blade row 31F of the final stage when the steam turbine 1B is in rated operation is subsonic speed, the flow velocity of the steam S may further increase in a region close to the shroud 34 to become supersonic speed. On the other hand, in the present embodiment, in the first region P11 of the diffuser 60, the cross-sectional area A1 of the annular flow passage 100 gradually becomes smaller toward the second side Dad in the axial direction Da. The annular flow passage 100 is narrowed, so that the flow velocity (mach number) of the steam S flowing out from the rotor blade row 31F of the final stage is entirely reduced in the first region P11. As a result, the flow velocity of the steam S in a region close to the outer guide 61 in the radial direction Dr in the first region P11 is reduced from supersonic speed to subsonic speed. After that, the steam S flows from the first region P11 to the second region P12. The flow velocity of the steam S in the second region P12 is further reduced by gradually increasing the cross-sectional area A2 of the annular flow passage 100 toward the second side Dad in the axial direction Da while being reduced to the subsonic speed. Thus, the static pressure can be recovered. Accordingly, even when the flow velocity of the steam S flowing out from the rotor blade row 31F of the final stage is subsonic speed, it is possible to efficiently recover the static pressure of the steam S in the diffuser 60.

In addition, in the steam turbine 1B, the minimum cross-sectional area A1min of the annular flow passage 100 in the first region P11 is larger than the cross-sectional area Aw of the steam main flow passage 15 formed between the outer peripheral edge and the inner peripheral edge of the rotor blade row 31F of the final stage. As a result, it is possible to suppress the flow of steam S flowing out from the rotor blade row 31F of the final stage from being choked in the first region P11 (the flow rate does not change even if the pressure ratio is large).

In addition, in the steam turbine 1B, the maximum cross-sectional area A2max of the annular flow passage 100 in the second region P12 is larger than the maximum cross-sectional area A1max of the annular flow passage 100 in the first region P11. As a result, the flow velocity of the steam S flowing into the second region P12 after the flow velocity is reduced in the first region P11 can be surely reduced.

In addition, in the steam turbine 1B, the inner guide 62 is formed so as to extend linearly from the first end 621 of the inner guide of the first side Dau in the axial direction Da toward the second end 622 of the inner guide of the second side Dad in the axial direction Da. Further, the inner guide 62 is inclined at the third inclination angle θ3 that is larger than the first inclination angle θ1 of the first inclined portion 611 and smaller than the second inclination angle θ2 of the second inclined portion 612. As a result, in the annular flow passage 100, the turbulence of the flow of the steam S at the inner side Dri in the radial direction Dr can be suppressed.

In addition, in the steam turbine 1B, the length L2 of the axial direction Da of the second region P12 is 0.5 to 2.0 times the length L1 of the axial direction Da of the first region P11. As a result, the flow velocity of the steam S can be adjusted in a well-balanced manner in the first region P11 and the second region P12. Therefore, it is possible to efficiently recover the static pressure.

Other Embodiments

The embodiments of the present disclosure have been described in detail with reference to the drawings, but the specific configuration is not limited to the embodiments, and includes design changes and the like within a range without departing from the gist of the present disclosure.

For example, the configuration of each part of the steam turbines 1A and 1B, including the number of stages of the rotor blade row 31 and the stator vane row 41, can be changed as appropriate.

Additional Notes

The steam turbine described in each embodiment is grasped as follows, for example.

(1) A steam turbine 1A according to the first aspect includes a rotor shaft 21 that is configured to rotate about an axis O, a plurality of rotor blade rows 31 that are fixed to an outer side Dro in a radial direction Dr about the axis O with respect to the rotor shaft 21 and disposed at intervals in an axial direction Da along which the axis O extends, a casing 10 that covers the rotor shaft 21 and the plurality of rotor blade rows 31, and stator vane rows 41 that are fixed to the casing 10 and, in which each of the stator vane rows 41 is disposed at intervals on a first side Dau in the axial direction Da with respect to each of the plurality of rotor blade rows 31, in which the casing 10 has a diffuser 70 that is configured to guide steam S flowing out from the rotor blade row 31F of a final stage, which is disposed on a second side Dad farthest in the axial direction Da among the plurality of rotor blade rows 31, to an outside of the casing 10, the diffuser 70 includes an outer guide 71 that gradually expands to the outer side Dro in the radial direction Dr from the first side Dau to the second side Dad in the axial direction Da, and an inner guide 72 that is disposed at intervals inner side Dri in the radial direction Dr with respect to the outer guide 71 and gradually expands to the outer side Dro in the radial direction Dr from the first side Dau to the second side Dad in the axial direction Da, the inner guide 72 has an inner curved diameter-expanded portion 73 that gradually expands to the outer side Dro in the radial direction Dr while curving from the first side Dau to the second side Dad in the axial direction Da, and the outer guide 71 includes a first diameter-expanded portion 711 that is disposed in a region closest to the rotor blade row 31F of the final stage in the axial direction Da and gradually expands to the outer side Dro in the radial direction Dr with a first radius of curvature R1 from the first side Dau to the second side Dad in the axial direction Da, and a second diameter-expanded portion 712 that is connected to the first diameter-expanded portion 711 on the second side Dad in the axial direction Da and gradually expands to the outer side Dro in the radial direction Dr with a second radius of curvature R2 larger than the first radius of curvature R1 from the first side Dau to the second side Dad in the axial direction Da.

In the steam turbine 1A, the steam S flowing out from the rotor blade row 31F of the final stage flows along the inner curved diameter-expanded portion 73 in the portion close to the inner guide 72 in the radial direction Dr. As a result, in the vicinity of the inner curved diameter-expanded portion 73, the steam S flows such that the flow direction is changed to the outer side Dro in the radial direction Dr while suppressing the separation from the inner curved diameter-expanded portion 73. In addition, the steam S flowing out from the rotor blade row 31F of the final stage flows along the first diameter-expanded portion 711 in the portion close to the outer guide 71 in the radial direction Dr. By flowing the steam S along the curved surface, the steam S flowing out from the rotor blade row 31F of the final stage can be efficiently guided. After that, the steam S flowing in the portion close to the outer guide 71 in the radial direction Dr flows along the second diameter-expanded portion 712. The second diameter-expanded portion 712 slowly expands to the outer side Dro in the radial direction Dr as compared with the first diameter-expanded portion 711. Thus, the second diameter-expanded portion 712 is formed along the direction in which the steam S flowing from the first diameter-expanded portion 711 separates off. The flow of steam S can be suppressed to the inner side Dri of the Radial direction Dr. Therefore, the steam S flowing along the first diameter-expanded portion 711 flows along the second diameter-expanded portion 712 without causing separation. As a result, it is possible to suppress the occurrence of separation in the flow of steam S on the outer side Dro in the radial direction Dr. In this way, the diffuser 70 can reduce the flow velocity while suppressing the separation of the steam S. Accordingly, it is possible to efficiently recover the static pressure of the steam S in the diffuser 70.

(2) The steam turbine 1A according to the second aspect is the steam turbine 1A of (1), in which a radius of curvature R3 of the inner curved diameter-expanded portion 73 may be larger than the first radius of curvature R1.

Thus, the occurrence of separation can be efficiently suppressed even on the inner side Dri in the radial direction Dr. As a result, it becomes possible to more efficiently recover the static pressure of the steam S in the diffuser 70.

(3) The steam turbine 1A according to the third aspect is the steam turbine 1A of (1) or (2), in which a length of the second diameter-expanded portion 712 in the axial direction Da may be 0.5 to 2.0 times a length of the first diameter-expanded portion 711 in the axial direction Da.

As a result, the flow velocity of the steam S can be adjusted in a well-balanced manner in the first region P1 and the second region P2. Therefore, it is possible to efficiently recover the static pressure.

(4) A steam turbine 1B according to the fourth aspect includes a rotor shaft 21 that is configured to rotate about an axis O, a plurality of rotor blade rows 31 that are fixed to an outer side Dro in a radial direction Dr about the axis O with respect to the rotor shaft 21 and disposed at intervals in an axial direction Da along which the axis O extends, a casing 10 that covers the rotor shaft 21 and the plurality of rotor blade rows 31, and stator vane rows 41 that are fixed to the casing 10, in which each of the stator vane rows 41 is disposed at intervals on a first side Dau in the axial direction Da with respect to each of the plurality of rotor blade rows 31, in which the casing 10 has a diffuser 60 that is configured to guide steam S flowing out from the rotor blade row 31F of a final stage, which is disposed on a second side Dad farthest in the axial direction Da among the plurality of rotor blade rows 31, to an outside of the casing 10, the diffuser 60 includes an outer guide 61 that gradually expands to the outer side Dro in the radial direction Dr from the first side Dau to the second side Dad in the axial direction Da, an inner guide 62 that is disposed at intervals inner side Dri in the radial direction Dr with respect to the outer guide 61 and gradually expands to the outer side Dro in the radial direction Dr from the first side Dau to the second side Dad in the axial direction Da, and the diffuser 60 includes a first region P11 that is a region closest to the rotor blade row 31F of the final stage in the axial direction Da, and in which a cross-sectional area A1 of a flow passage defined between the outer guide 61 and the inner guide 62 gradually decreases toward the second side Dad in the axial direction Da, and a second region P12 that is connected to the first region P11 on the second side Dad in the axial direction Da, in which the cross-sectional area A2 of the flow passage gradually increases toward the second side Dad in the axial direction Da.

As a result, the flow passage is narrowed in the first region P11 of the diffuser 60, so that the flow velocity (mach number) of the steam S flowing out from the rotor blade row 31F of the final stage is entirely reduced in the first region P11. As a result, the flow velocity of the steam S in a region close to the outer guide 61 in the radial direction Dr in the first region P11 is reduced from supersonic speed to subsonic speed. After that, the steam S flows from the first region P11 to the second region P12. The flow velocity of the steam S in the second region P12 is further reduced by gradually increasing the cross-sectional area A2 of the flow passage toward the second side Dad in the axial direction Da while being reduced to the subsonic speed. Thus, the static pressure can be recovered. Accordingly, even when the flow velocity of the steam S flowing out from the rotor blade row 31F of the final stage is subsonic speed, it is possible to efficiently recover the static pressure of the steam S in the diffuser 60.

(5) The steam turbine 1A according to the fifth aspect is the steam turbine 1B of (4), in which a minimum cross-sectional area A1min of the flow passage in the first region P11 may be larger than a cross-sectional area Aw of the flow passage defined between an outer peripheral edge and an inner peripheral edge of the rotor blade row 31F in the final stage.

As a result, it is possible to suppress the flow of steam S flowing out from the rotor blade row 31F of the final stage from being choked in the first region P11.

(6) The steam turbine 1B according to the sixth aspect is the steam turbine 1B of (4) or (5), in which a maximum cross-sectional area A2max of the flow passage in the second region P12 may be larger than a maximum cross-sectional area A1max of the flow passage in the first region P11.

As a result, the flow velocity of the steam S flowing into the second region P12 after the flow velocity is reduced in the first region P11 can be surely reduced.

(7) The steam turbine 1B according to the seventh aspect is the steam turbine 1B of any one of (4) to (6), in which the outer guide 61 includes a first inclined portion 611 that is disposed in the first region P11 and is inclined at a first inclination angle θ1 with respect to the axis O, and a second inclined portion 612 that is disposed in the second region P12 and is inclined at a second inclination angle θ2 larger than the first inclination angle θ1 with respect to the axis O, and the inner guide 62 may be formed linearly from a first end 621 of the inner guide on the first side Dau in the axial direction Da toward a second end 622 of the inner guide on the second side Dad in the axial direction Da, and a third inclination angle θ3 of the inner guide 62 with respect to the axis O may be larger than the first inclination angle θ1 and smaller than the second inclination angle θ2.

As a result, in the annular flow passage 100, the turbulence of the flow of the steam S at the inner side Dri in the radial direction Dr can be suppressed.

(8) The steam turbine 1B according to the eighth aspect is the steam turbine 1B of any one of (4) to (7), in which a length of the second region P12 in the axial direction Da may be 0.5 to 2.0 times a length of the first region P11 in the axial direction Da.

As a result, the flow velocity of the steam S can be adjusted in a well-balanced manner in the first region P11 and the second region P12. Therefore, it is possible to efficiently recover the static pressure.

EXPLANATION OF REFERENCES

1A, 1B: Steam turbine
10: Casing
15: Steam main flow passage
20: Rotor
21: Rotor shaft
22: Shaft core portion
23: Disc portion
31: Rotor blade row
31F: Rotor blade row of final stage
32: Rotor blade
33: Rotor blade main body
34: Shroud
35: Platform
41: Stator vane row
42: Stator vane
43: Outer ring
44: Stator vane main body
46: Inner ring
51: Exhaust casing
513: Exhaust port
60, 70: Diffuser
61, 71: Outer guide
611: First inclined portion
612: Second inclined portion
62, 72: Inner guide
621, 731: First end of inner guide
622, 732: Second end of inner guide
711: First diameter-expanded portion
7111: First end of diameter-expanded portion
7112: Second end of diameter-expanded portion
7113: Intermediate portion of diameter-expanded portion
712: Second diameter-expanded portion
73: Inner curved diameter-expanded portion
733: Inner guide intermediate portion
100: Annular flow passage
A1: Cross-sectional area
A1max: Maximum cross-sectional area
A1min: Minimum cross-sectional area
A2: Cross-sectional area
A2max: Maximum cross-sectional area
Aw: Cross-sectional area
Da: Axial direction
Dad: Second side
Dau: First side
Dc: Circumferential direction
Dr: Radial direction
Dri: Inner side
Dro: Outer side
O: Axis
P1, P11: First region
P2, P12: Second region
R1: First radius of curvature
R2: Second radius of curvature
R3: Third radius of curvature
S: Steam
θ1: First inclination angle
θ2: Second inclination angle
θ3: Third inclination angle

What is claimed is:

1. A steam turbine comprising:

a rotor shaft that is configured to rotate about an axis;

a plurality of rotor blade rows that are fixed radially outwards of the rotor shaft and disposed at intervals in an axial direction along which the axis extends;

a casing that covers the rotor shaft and the plurality of rotor blade rows; and stator vane rows that are fixed to the casing, wherein each of the stator vane rows is disposed at intervals axially upstream of a respective rotor blade row of the plurality of rotor blade rows, wherein the casing has a diffuser that is configured to guide steam flowing out of the casing from a rotor blade row of a final stage that is disposed axially most downstream among the plurality of rotor blade rows, the diffuser comprises:

an outer guide that gradually expands radially outwards of the diffuser from axially upstream of the diffuser to axially downstream of the diffuser, and an inner guide that is disposed at intervals radially inwards of the outer guide and gradually expands radially outwards of the diffuser from axially upstream of the diffuser to axially downstream of the diffuser, the inner guide has an inner curved diameter-expanded portion that gradually expands radially outwards of the diffuser while curving from axially upstream of the diffuser to axially downstream of the diffuser, the outer guide comprises:

a first diameter-expanded portion that is disposed in a region closest to the rotor blade row of the final stage in the axial direction and gradually expands radially outwards of the diffuser with a first radius of curvature from an axially upstream end of the first diameter-expanded portion to an axially downstream end of the first diameter-expanded portion; and a second diameter-expanded portion that is connected to the first diameter-expanded portion axially downstream of the first diameter-expanded portion and gradually expands radially outwards of the diffuser with a second radius of curvature from an axially upstream end of the second diameter-expanded portion to an axially downstream end of the second diameter-expanded portion, the second radius of curvature being larger than the first radius of curvature, the second diameter-expanded portion forms a most axially downstream region of the outer guide, and a length of the second diameter-expanded portion in the axial direction is 0.5 to 2.0 times a length of the first diameter-expanded portion in the axial direction.

2. The steam turbine according to claim 1, wherein a radius of curvature of the inner curved diameter-expanded portion is larger than the first radius of curvature.

* * * * *